US011710913B2

(12) United States Patent
Ambo

(10) Patent No.: US 11,710,913 B2
(45) Date of Patent: Jul. 25, 2023

(54) TERMINAL STORAGE PORTION SECURING TERMINALS WITHIN A HOUSING

(71) Applicant: DELTA PLUS CO., LTD., Mie (JP)

(72) Inventor: Tsugio Ambo, Saitama (JP)

(73) Assignee: DELTA PLUS CO., LTD., Mie (JP)

( * ) Notice: Subject to any disclaimer, the term of this patent is extended or adjusted under 35 U.S.C. 154(b) by 0 days.

(21) Appl. No.: 17/541,208

(22) Filed: Dec. 2, 2021

(65) Prior Publication Data

US 2022/0181801 A1 Jun. 9, 2022

(30) Foreign Application Priority Data

Dec. 4, 2020 (JP) ..... 2020-201769

(51) Int. Cl.
*H01R 9/24* (2006.01)

(52) U.S. Cl.
CPC ..... *H01R 9/2416* (2013.01)

(58) Field of Classification Search
CPC ..... H01R 9/2416–13/40; H01R 13/42; H01R 13/514
See application file for complete search history.

(56) References Cited

U.S. PATENT DOCUMENTS 8,021,199 B2 * 9/2011 Ambo ..... H01R 13/502 439/752

FOREIGN PATENT DOCUMENTS

| | | | |
|---|---|---|---|
| JP | 87968 | A | 1/1996 |
| JP | 1092506 | A | 4/1998 |
| JP | 2008130511 | A | 6/2008 |
| JP | 201015863 | A | 1/2010 |

* cited by examiner

*Primary Examiner* — Vanessa Girardi
(74) *Attorney, Agent, or Firm* — Li & Cai Intellectual Property Office

(57) ABSTRACT

[Problem] To allow a plurality of connection terminals to be reliably arranged in a storage case, and the storage case to be placed into a housing.
[Means for Resolution] A storage case 1 has a storage portion 2 in which female connection terminals T including connection portions at front ends are arranged in parallel along storage grooves 2*d*, and a cover 3 that covers the storage portion 2, and tubular temporarily storing portions 2*i* for inserting tips of connection portions Ta of the female connection terminals T for temporary storage are provided at the fronts of the respective storage grooves 2*d*.

6 Claims, 9 Drawing Sheets

TERMINAL STORAGE PORTION SECURING TERMINALS WITHIN A HOUSING

FIELD OF THE DISCLOSURE

The present invention relates to an electric connector in which a plurality of small connection terminals is mounted via a storage case.

BACKGROUND OF THE DISCLOSURE

In recent years, for example, in an automobile industry, there is a strong demand for miniaturization of parts to be used in order to achieve weight reduction. For example, as a large number of sensors are used, the number of signal wires increases, and it is necessary to reduce a size of an electric connector for connecting the wires.

In order to reduce the size of the electric connector, the connection terminal and an electric wire mounted in the electric connector need to be reduced in size and diameter. Recently, a connection terminal having a connection diameter of 1 mm or less has begun to be used, and an electric wire to be used having a diameter of about 0.5 mm is used.

Due to such miniaturization of the electric connector, it becomes difficult to form a case lance latching the connection terminal in a conventional housing, and an electric connector that prevents the connection terminal from coming off by another method is required.

Patent Document 1 discloses a connector structure in which two connection terminals 21 are accommodated in a flat plate-shaped accommodating portion 26, a lid is attached on the accommodating portion 26, and these parts are inserted into a housing body 47 as illustrated in FIGS. 1 to 7.

CITATION LIST

Patent Document

Patent Document 1: JP-A-2019-133944

SUMMARY OF THE DISCLOSURE

Technical Problem

In the connector structure of Patent Document 1, a case lance is not used, and the connection terminals are arranged and then mounted on the housing body. Since the case lance is not used, the size can be reduced. The connector structure of Patent Document 1 is exclusively for shielded twisted pair (STP) cables, and accommodates a pair of cables.

However, in wiring of an automobile, etc., the number of connection terminals accommodated in one electric connector is large in many cases and 20 or more in some cases. It is difficult to arrange such a large number of small connection terminals at the same time as in Patent Document 1. For example, when a large number of connection terminals are arranged in parallel, connection terminals arranged earlier may pop out from an accommodating portion during the arrangement, and it takes time to finish arranging all the connection terminals.

Solution to Problem

An object of the invention is to solve the above-mentioned problems and to provide an electric connector in which a large number of connection terminals are easily arranged side by side at the same time and mounted in a housing while temporarily storing connection terminals in a storage case using a cover.

Advantageous Effects of the Invention

According to an electric connector according to the invention, a large number of connection terminals are reliably arranged and stored while being individually temporarily stored in a temporarily storing portion of a storage case using a temporarily stored portion thereof, and the storage case is placed into a housing.

DETAILED DESCRIPTION OF THE EXEMPLARY EMBODIMENTS

Figure 1:
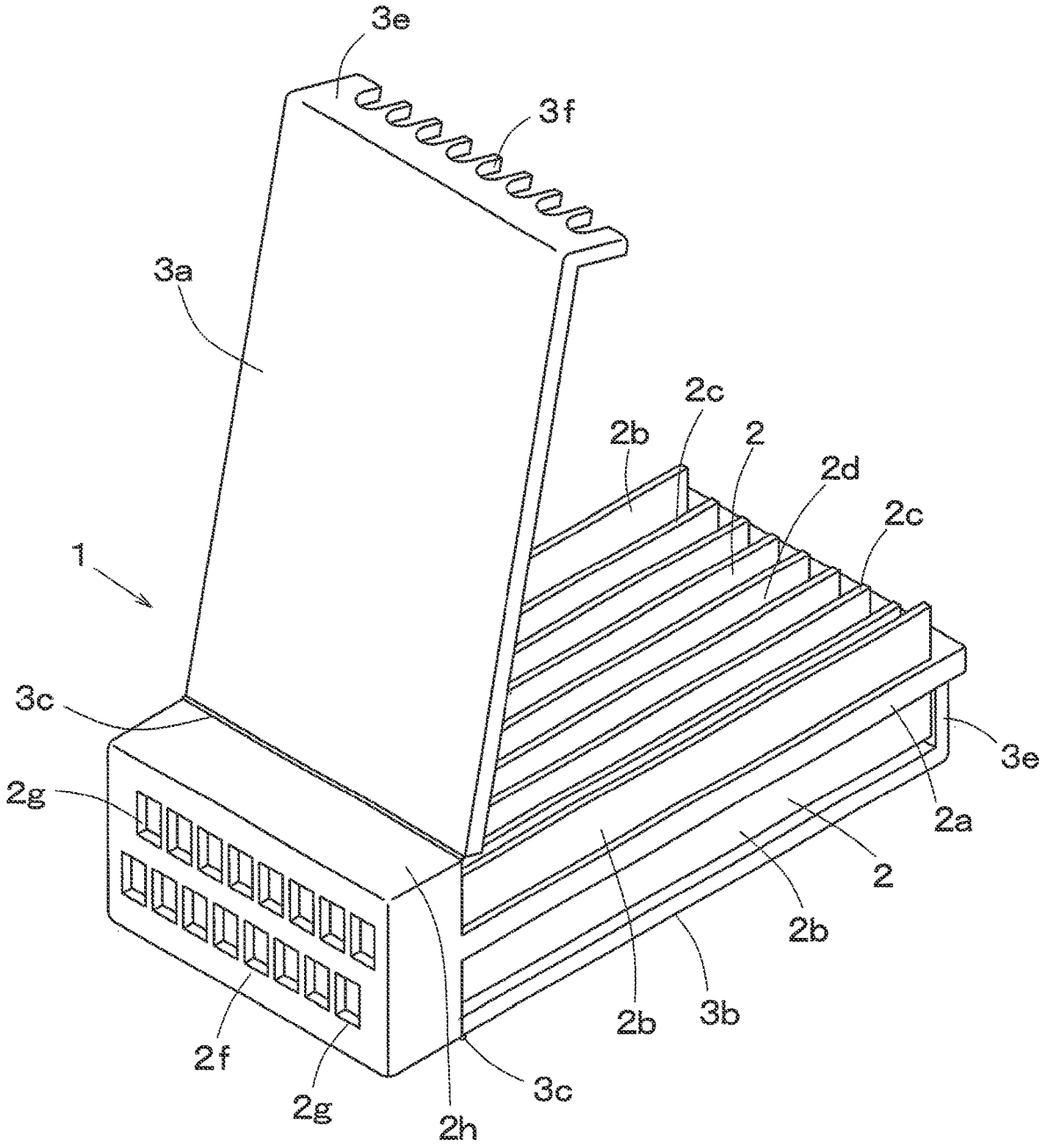
FIG. 1 is a perspective view of a state in which one cover of a storage case is opened.
Figure 2:
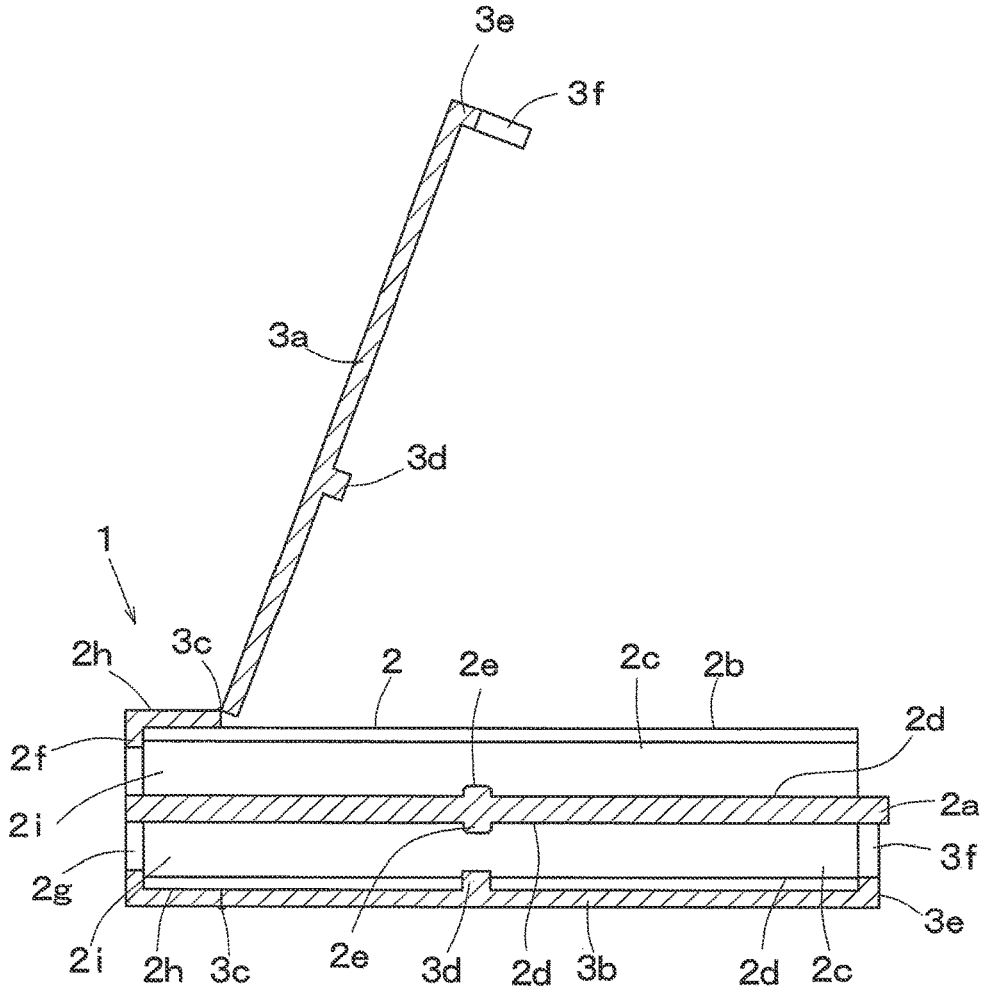
FIG. 2 is a cross-sectional view of the storage case.

FIG. 1 is a perspective view of a storage case 1 placed into a housing of an electric connector, illustrating a state in which one cover is opened, and FIG. 2 is a cross-sectional view of this state. The storage case 1 includes a storage portion 2 which is integrally injection-molded with a synthetic resin material and stores connection terminals on both upper and lower surfaces, and plate body-shaped covers 3*a* and 3*b* for covering the storage portion 2 storing the connection terminals. The covers 3*a* and 3*b* are attached to both the upper and lower surfaces of the storage portion 2 via thin hinges 3*c*, respectively. In FIGS. 1 and 2, the cover 3*a* in an upper part is in an open state and the cover 3*b* in a lower part is in a closed state. The storage case 1 has, for example, a height of 5.6 mm, a width of 9.75 mm, and a length of 20.8 mm.

The storage portion 2 is vertically partitioned by a bottom plate 2*a* having a thickness of 0.8 mm, and side plates 2*b* having a height of 1.9 mm are provided at both side portions on both upper and lower surfaces of the bottom plate 2*a* in a wall shape. Further, between the side plates 2*b*, partition plates 2*c* having a height lower than that of the side plates 2*b* and having a thickness of 0.25 mm are arranged in parallel with the side plates 2*b*. Assuming that the number of female connection terminals stored in the storage portion 2 is, for example, eight on one side, the number of partition plates 2*c* is seven on one side and 14 on both sides. A storage groove 2*d* having a width of 0.9 mm is formed between these partition plates 2*c*, and eight storage grooves 2*d* are arranged in parallel on one side to store connection terminals.

Since the connection terminals arranged at the top and bottom are stored with half right and left offset due to the space occupancy, the storage grooves 2*d* are provided at positions shifted to the right and left on the upper and lower surfaces. Further, on the bottom plate 2*a* at a center of each storage groove 2*d*, a latching projection 2*e* having a height of 0.2 mm and a width of 0.3 mm that fits into a latching hole provided in the connection terminal is provided.

A front plate 2*f* provided at a front of the storage portion 2 has eight upper holes 2*g* and eight lower holes 2*g*, each of which has a height of 1.6 mm and a width of 0.85 mm, such that a total of sixteen holes corresponding to the storage grooves 2*d* are shifted to the right and left and open in order to insert opponent male connection terminals from the front side.

A part between the front plate 2*f* at a front end of the storage portion 2 and the hinge 3*c* is covered with a cover plate 2*h*, which is a cover portion, and the cover plate 2*h* is formed of a plate body having a length of 2.7 mm from the front plate 2*f* and a thickness of 1.45 mm. At a front end of each storage groove 2*d*, a temporarily storing portion 2*i* having a tubular shape surrounded by the bottom plate 2*a*, the partition plate 2*c*, the front plate 2*f*, and the cover plate 2*h* is formed, and at the time of mounting into the storage case 1 of the connection terminal, a temporarily stored portion of the connection terminal is inserted into the temporarily storing portion 2*i* for temporary storage.

The plate body-shaped covers 3*a* and 3*b* are attached to the storage portion 2 so as to be openable and closable by the hinge 3*c*, and the covers 3*a* and 3*b* cover the storage groove 2*d* of the storage portion 2. A thickness of the covers 3*a* and 3*b* is the same as that of the cover plate 2*h*. However, at an approximately center portion, a latching step portion 3*d* having a height of 0.55 mm for latching a rear portion of a connection portion of the connection terminal protrudes toward the inside of the storage grooves 2*d* for each storage groove 2*d*. Further, each of rear ends of the covers 3*a* and 3*b* is a rear surface portion 3*e* having a thickness of 0.8 mm, and an opening 3*f* through which an electric wire connected to the connection terminal is passed is formed in the rear surface portion 3*e*.

Note that in the embodiment, the covers 3*a* and 3*b* are integrated with a rear edge of the temporarily storing portion 2*i* on the outer side via the hinges 3*c* and provided so as to be openable and closable with respect to the storage groove 2*d*. However, the covers 3*a* and 3*b* may be separated from the storage portion 2. Further, the storage portion 2 and the storage groove 2*d* may be formed on only one side of the storage case 1.

Figure 3:
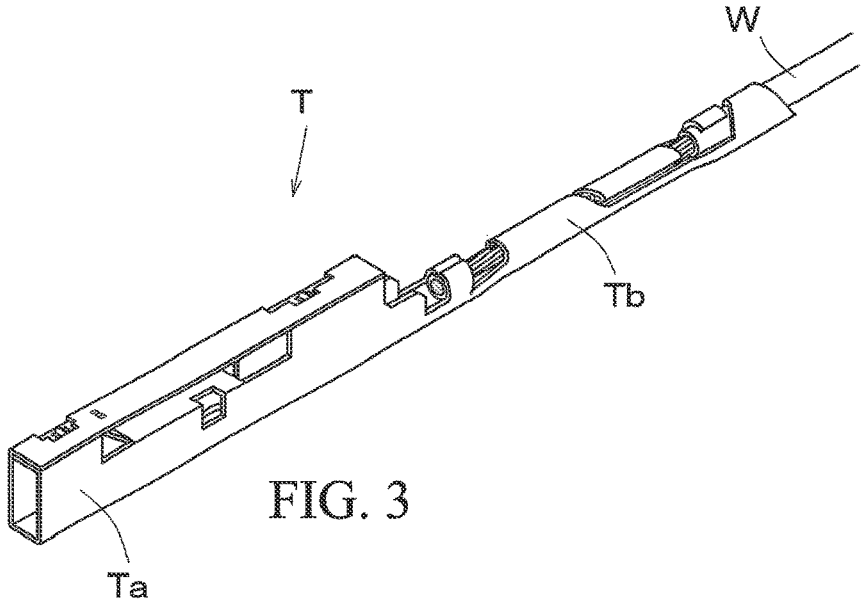
FIG. 3 is a perspective view of a female connection terminal in a state where an electric wire is connected.

FIG. 3 is a perspective view of a female connection terminal T in a state where an electric wire W mounted on the storage case 1 is connected. The female connection terminal T has a square tubular receiving connection portion Ta having a width of 0.8 mm and a height of 1.8 mm at the front, and a crimping portion Tb to which the electric wire W is connected at the rear. A tip of the receiving connection portion Ta serves as the temporarily stored portion. Note that a diameter of the electric wire W used is 0.5 mm.

Figure 4:
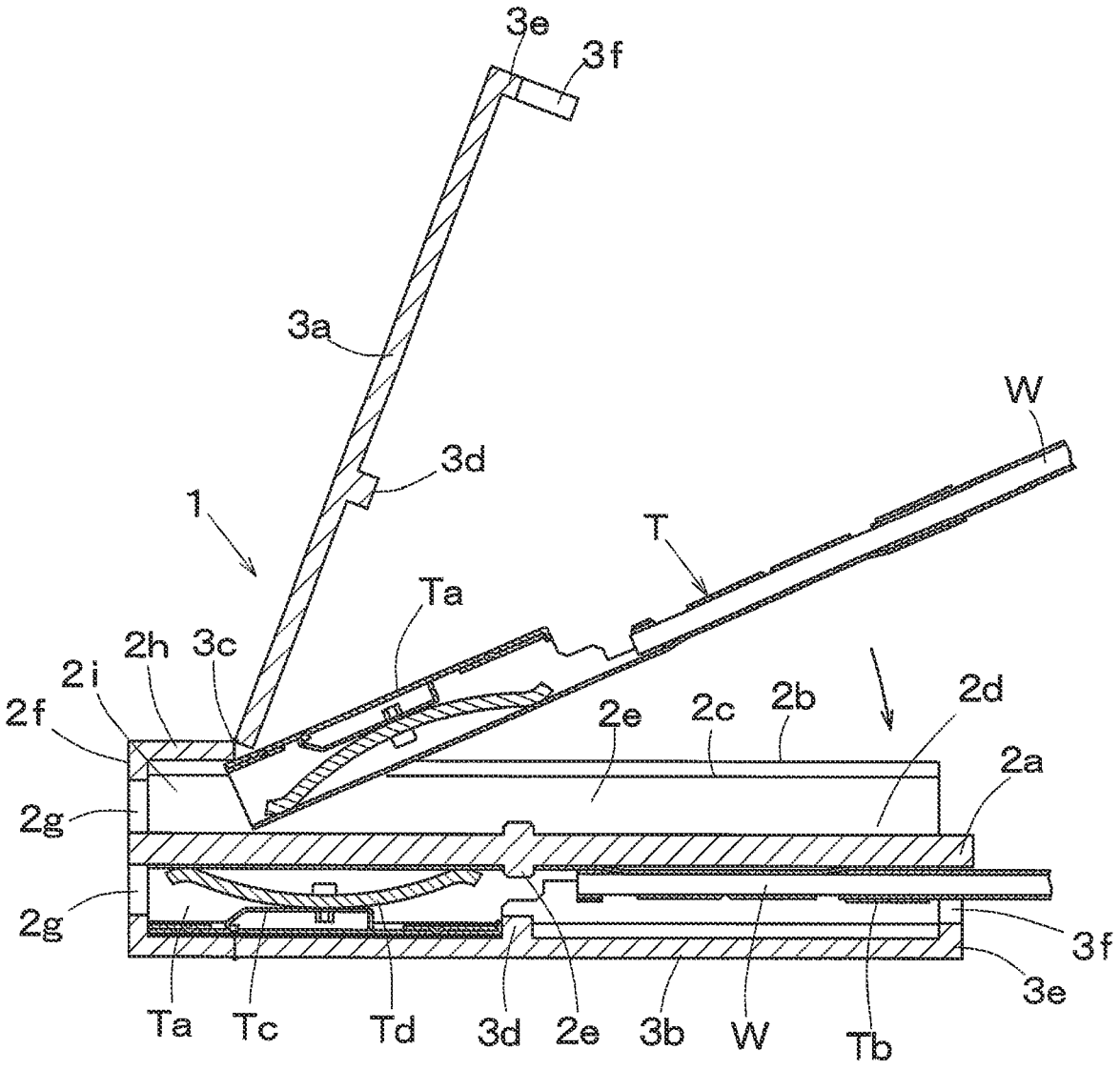
FIG. 4 is an explanatory view in which the female connection terminal is stored in the storage case.

As illustrated in FIG. 4, a movable contact piece Td separate from a fixed contact portion Tc is provided in the connection portion Ta, and an insertion end of an opponent connection terminal is put between the fixed contact portion Tc and the movable contact piece Td.

Figure 5:
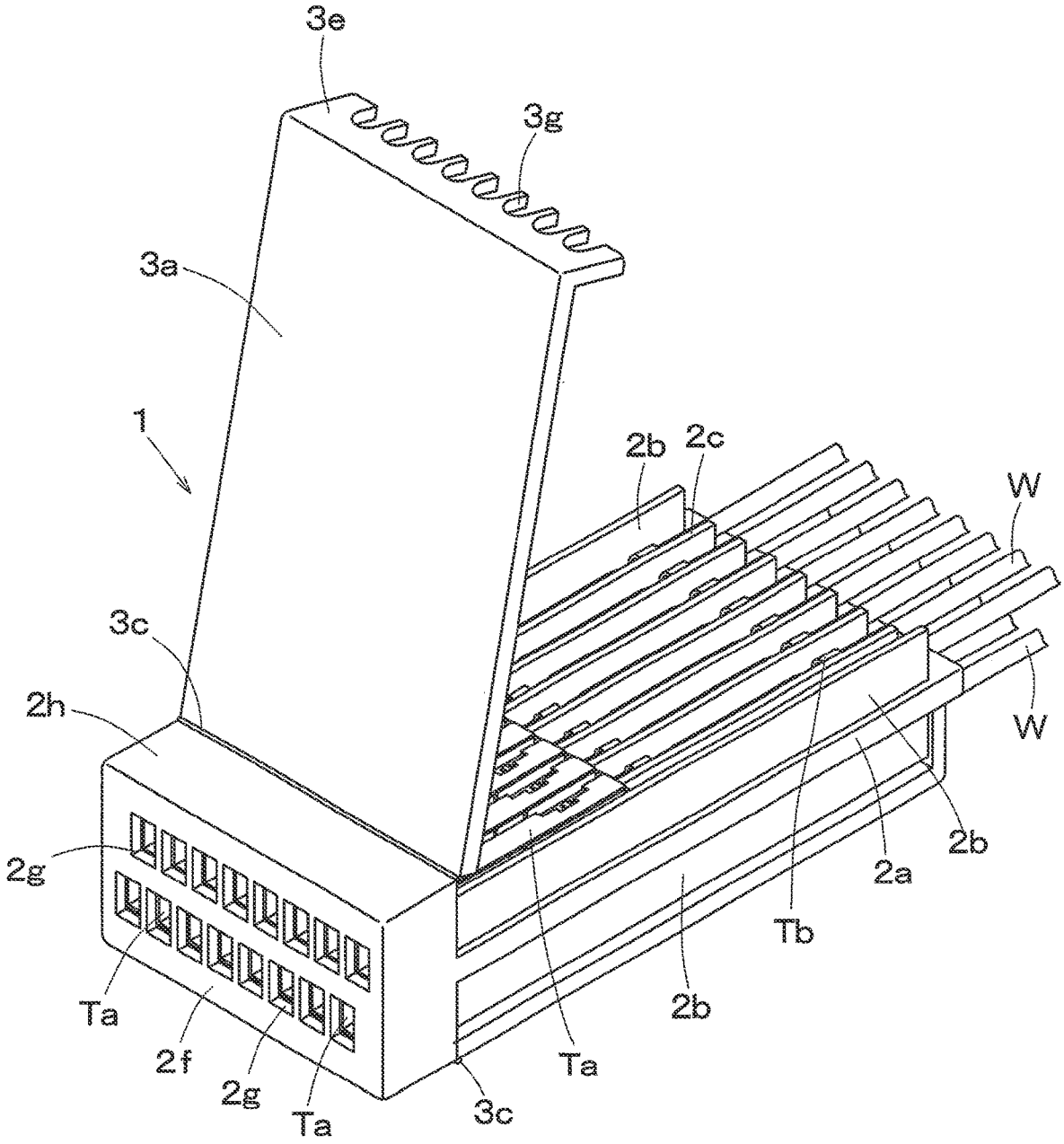
FIG. 5 is a perspective view of the storage case in which the female connection terminal is stored.

To store this female connection terminal T in the storage case 1, as illustrated in FIG. 4, the cover 3*a* is opened, the tip of the connection portion Ta, which is the temporarily stored portion of the connection terminal T, is directed diagonally downward, and each tip is pushed into the front side of the storage groove 2*d*. Then, the tip of the connection portion Ta enters the temporarily storing portion 2*i* and is temporarily stored. Further, by making a posture of the connection terminal T horizontal and pushing the connection terminal T into the storage groove 2*d*, the latching projection 2*e* of the storage groove 2*d* is fit into the latching hole formed in the lower part of the connection terminal T, and the connection terminal T is positioned in the storage groove 2*d* as illustrated in FIG. 5. Note that FIGS. 4 and 5 illustrate a state in which the connection terminal T is previously stored in the lower storage groove 2*d*.

Every time the female connection terminal T is stored in the storage groove 2*d*, the connection portion Ta is inserted into the temporarily storing portion 2*i* and undergoes a temporary storage state. Thus, there is no risk that the connection terminal T may come out of the storage groove 2*d* during a storing operation or the previously stored connection terminal T may come out of the storage groove 2*d*.

Further, when the connection terminal T is stored in the storage case 1 and the covers 3*a* and 3*b* are closed, by locking means (not illustrated) provided on both sides of the storage portion 2 and on both side surfaces of the covers 3*a* and 3*b*, the covers 3*a* and 3*b* are locked to the storage portion 2 so as not to be opened unexpectedly. Therefore, the covers 3*a* and 3*b* may not open even when the storage case 1 is turned upside down, and the connection terminal T may not fall off.

Figure 6:
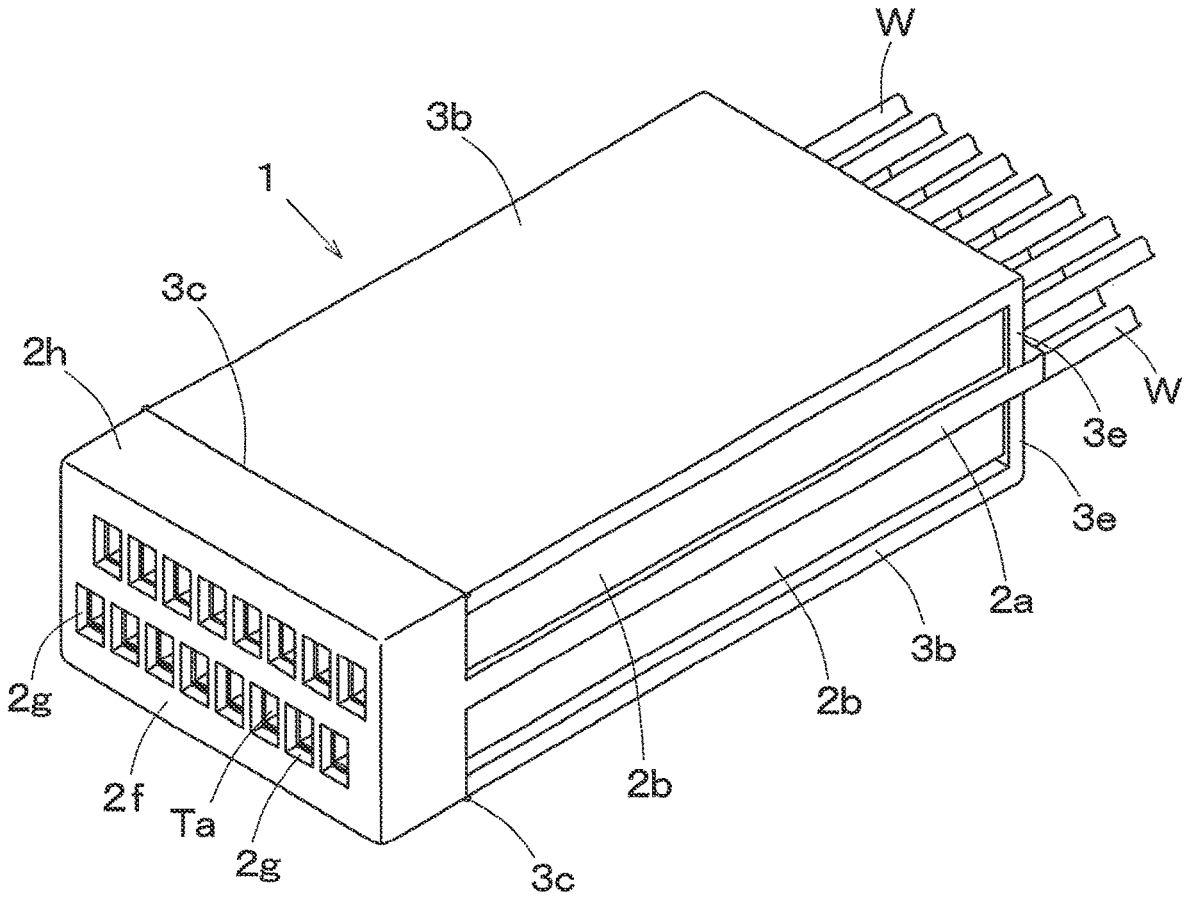
FIG. 6 is a perspective view of the storage case in a state where the female connection terminal is stored and the cover is closed.

In a state where the connection terminal T is stored in the storage case 1, a front end of the connection portion Ta comes into contact with a part of the front plate 2*f* around the hole 2*g*, the latching projection 2*e* provided in the storage groove 2*d* is fit into the latching hole provided behind the connection portion Ta, and the latching step portion 3*d* provided on each of the covers 3*a* and 3*b* latches to a step portion at a rear end of the connection portion Ta. In this way, movement of the connection terminal T particularly in a front-rear direction in the storage case 1 is restricted by a plurality of latching means and the connection terminal T is stably held. FIG. 6 is a perspective view of the storage case 1 in a state where sixteen female connection terminals T are accommodated in this way.

Figure 7:
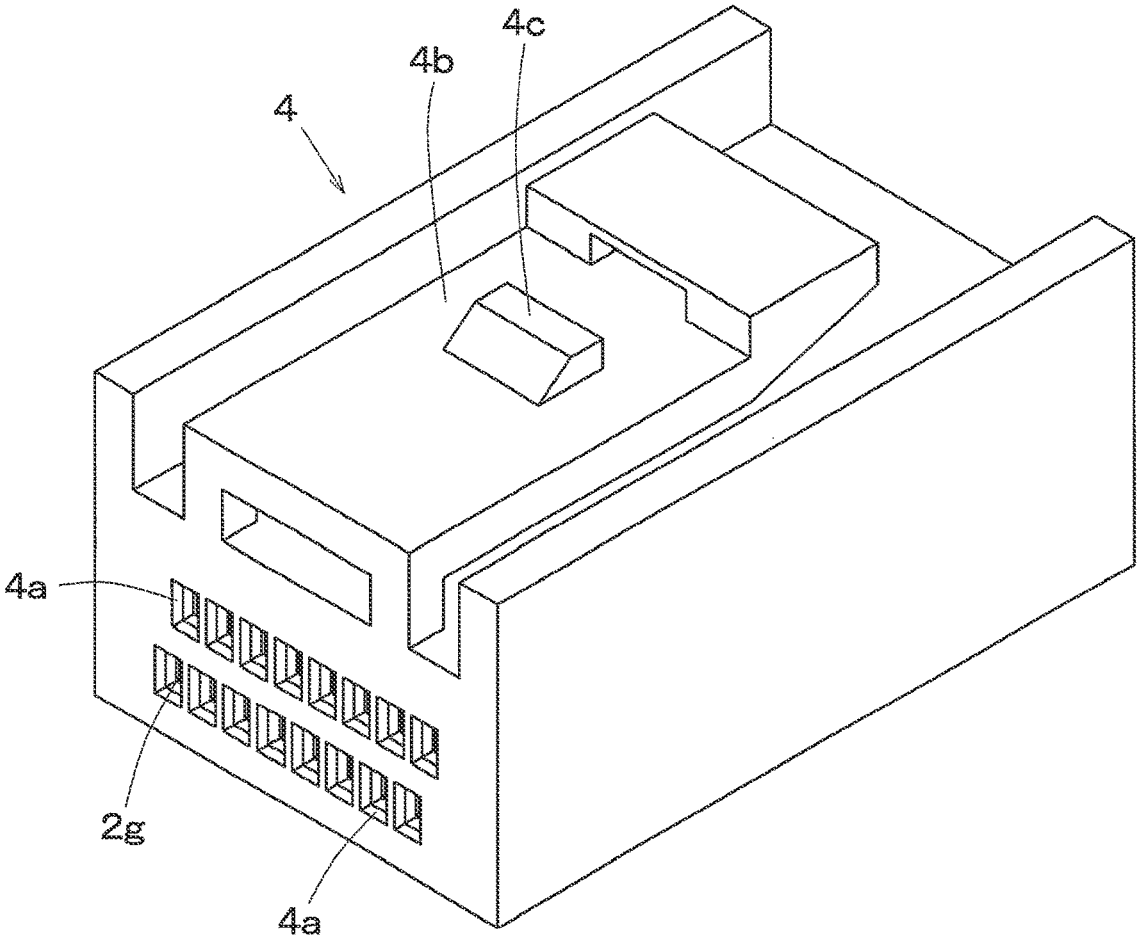
FIG. 7 is a perspective view of a housing.

FIG. 7 is a perspective view of the housing accommodating the storage case 1, and the housing 4 accommodates the storage case 1 in a state where the female connection terminal T is accommodated, is fit to the opponent electric connector, and connects internal connection terminals to each other. A rear part (not illustrated) of the housing 4 is open so that the storage case 1 can be inserted from the rear part.

The housing 4 has a substantially box shape having a height of 9.9 mm, a width of 12.55 mm, and a length of 22.5 mm. An accommodation chamber having the built-in storage case 1 is provided in the housing 4, and sixteen openings 4*a* are formed at the front of the accommodation chamber to insert the opponent male connection terminals, respectively. These openings 4*a* are continuous with the holes 2*g* of the storage case 1 in the housing 4 and have a size substantially equal to that of the holes 2*g*.

When the storage case 1 is mounted in the housing 4 in this way, usage as the electric connector is allowed. A part between the storage case 1 and the housing 4 is locked by locking means (not illustrated) so that the storage case 1 does not unexpectedly come out of the housing 4.

A movable locking lever 4*b* is provided in an upper part of the housing 4. The locking lever 4*b* has a support shaft at the front of the housing 4, a rear end thereof is a free end, and a hook 4*c* for locking to an opponent housing is formed on an upper side of an intermediate portion thereof.

Figure 8:
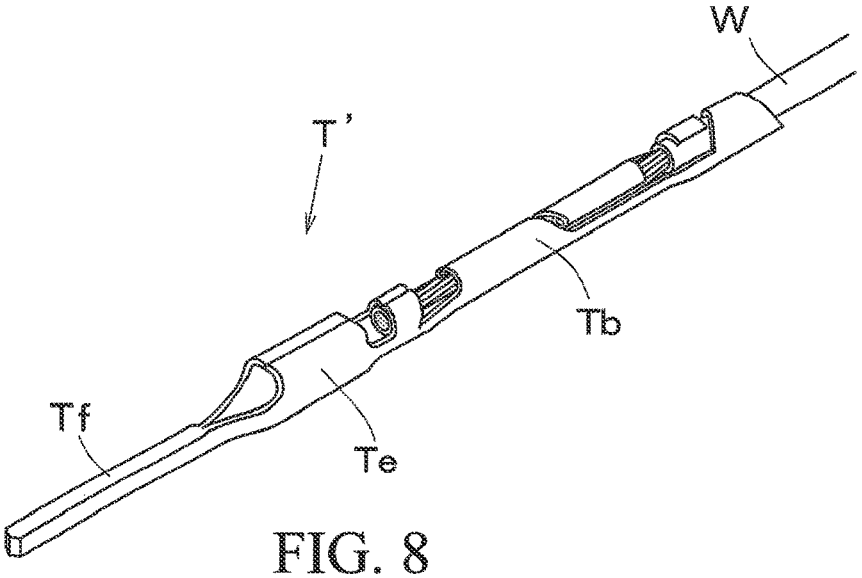
FIG. 8 is a perspective view of a male connection terminal in a state where an electric wire is connected.

In the above-described embodiment, a case where the female connection terminal T is used for the electric connector has been described. However, it is also possible to apply a male connection terminal T' as illustrated in FIG. 8. This male connection terminal T' includes a pin-shaped insertion end Tf to be inserted into the connection end Ta of an opponent female connection terminal T in front of a tubular root portion Te serving as a temporarily stored portion, and a rear end of the root portion Te is a step portion. In this case, a width dimension of the male connection terminal T' is almost the same as that of the female connection terminal T. However, a length of the insertion end Tf is, for example, 7 mm and a width thereof is 0.55 mm.

A storage case 1' for storing the male connection terminal T' is almost the same as the storage case 1 for the female connection terminal T. However, dimensions of a hole 2*g* of a front plate 2*f* for inserting the insertion end Tf, and positions of a latching projection 2*e* and latching step portions 3*d* of covers 3*a* and 3*b* are slightly different.

Figure 9:
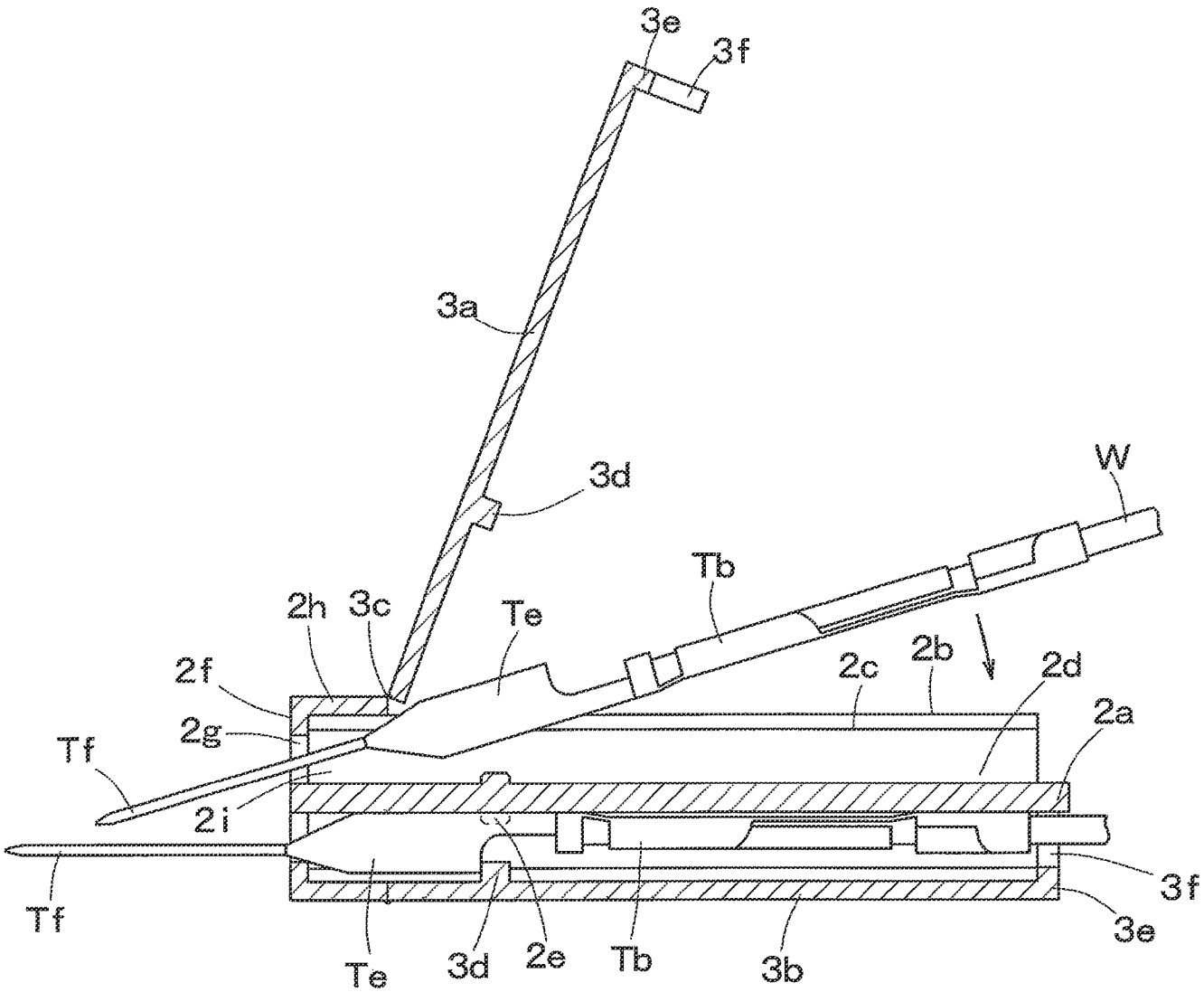
FIG. 9 is an explanatory view in which the male connection terminal is stored in the storage case.

To store the male connection terminal T' in the storage case 1', as illustrated in FIG. 9, similarly to the female connection terminal T, the insertion end Tf is inserted into a storage groove 2*d* in an oblique direction, the insertion end Tf is projected from the hole 2*g* of the front plate 2*f* through a temporarily storing portion 2*i* to the front of the storage case 1', and the root portion Te is temporarily stored in the temporarily storing portion 2*i* as a temporarily stored portion. Further, the male connection terminal T' is placed horizontally in the storage groove 2*d* as shown in a lower stage, and the covers 3*a* and 3*b* are closed. In this state, an end portion of a rear end of the root portion Te of the male connection terminal T' is latched to the latching step portion 3*d* of the covers 3*a* and 3*b*, and the latching projection 2*e* is fit into a latching hole provided in the root portion Te.

Figure 10:
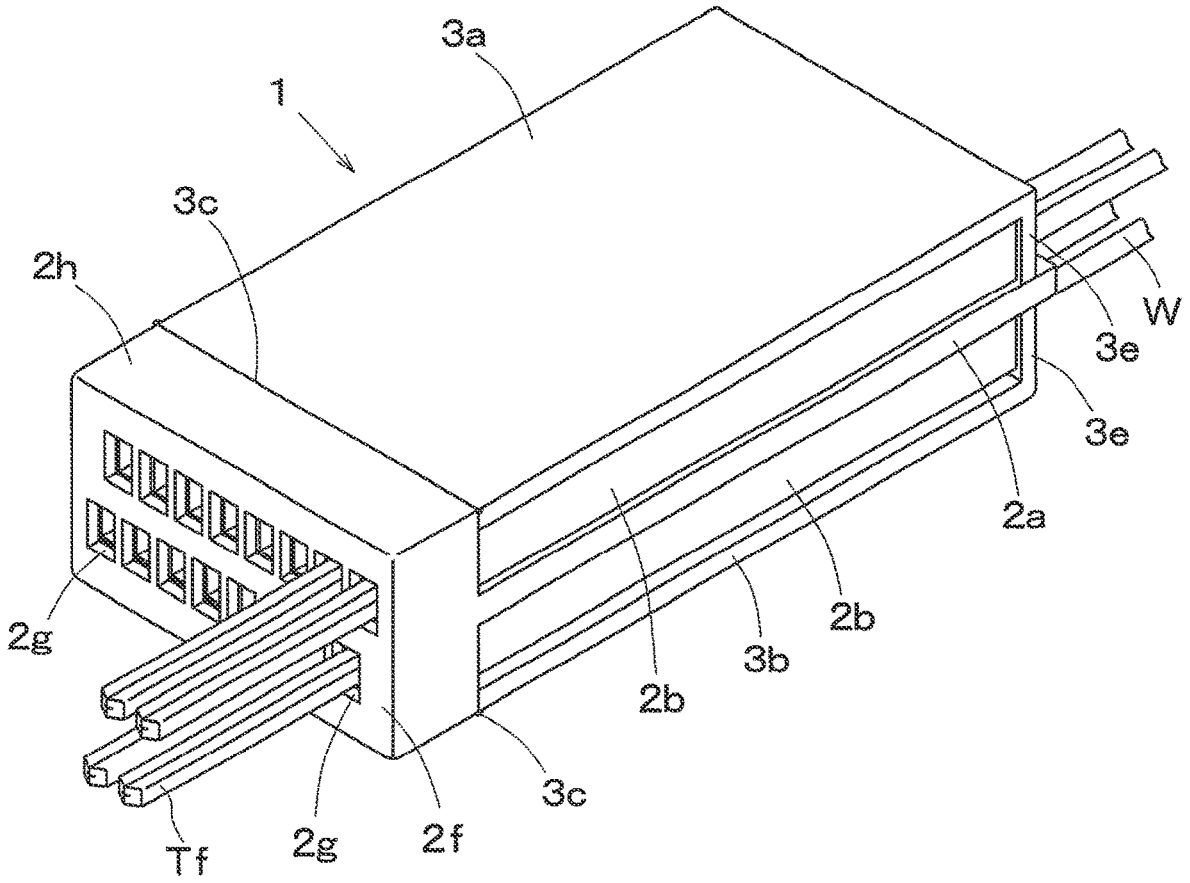
FIG. 10 is a perspective view of the storage case in a state where the male connection terminal is stored and the cover is closed.

FIG. 10 is a perspective view of the storage case 1 in a state where the male connection terminal T' is stored, and the insertion end Tf of the male connection terminal T' projects in front of the storage case 1'. Note that originally, sixteen male connection terminals T' are mounted. However, in FIG. 10, only four male connection terminals T' are illustrated and the others are omitted.

Figure 11:
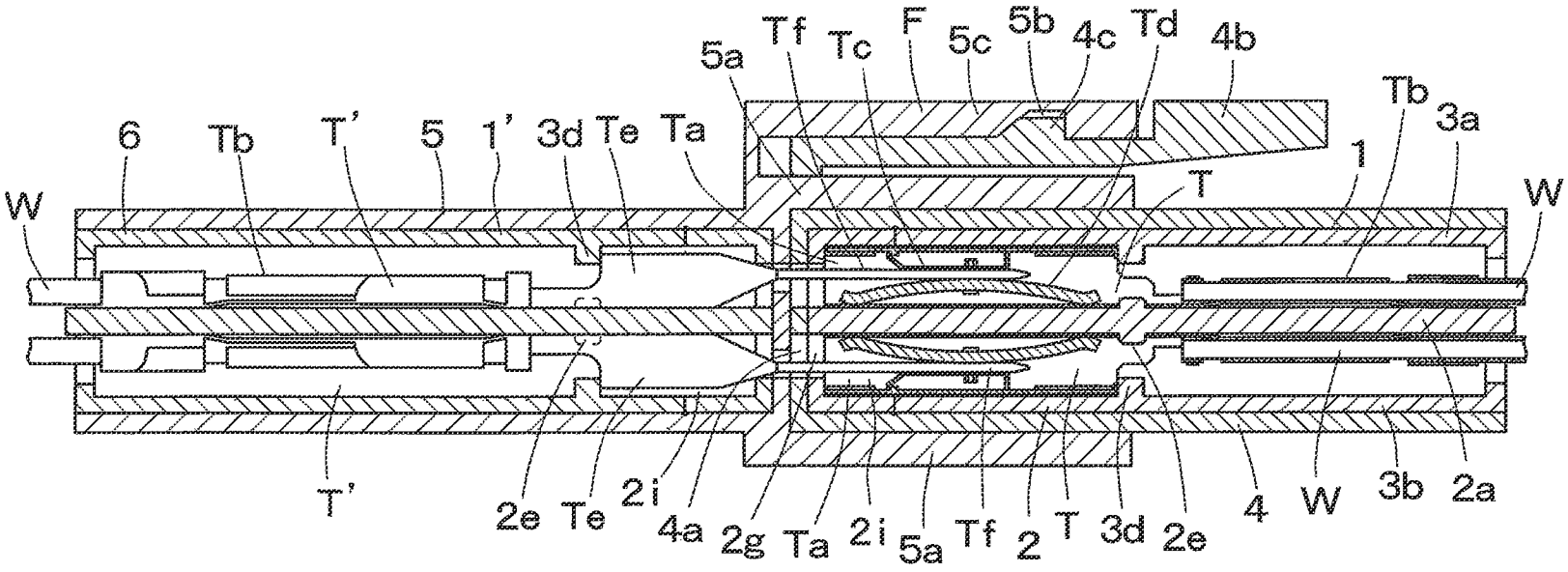
FIG. 11 is a cross-sectional view of a fit state with an opponent electric connector.

FIG. 11 is a cross-sectional view of a state in which the housing 4 equipped with the female connection terminal T is coupled to the opponent electric connector, and the male connection terminal T' is mounted in the housing 5 of the opponent connector through the storage case 1. The housing 5 has a frame 5*a* surrounding the housing 4, and a locked portion 5*c* having a locking groove 5*b* that cooperates with the locking lever 4*b* of the housing 4 to perform locking with the housing 4 is provided above the frame 5*a*.

When the opponent housing 5 is pushed and fit to the housing 4 from the front, the insertion end Tf of the male connection terminal T' in the housing 5 is inserted into the connection portion Ta of the female connection terminal T via the opening 4*a* of the housing 4 and the hole 2*g* of the storage case 1. The insertion end Tf is put between the fixed contact portion Tc and the elastic movable contact piece Td in the connection portion Ta of the female connection terminal T, and the male connection terminal T' and the female connection terminal T are electrically connected to each other.

At this time, the locked portion 5*c* of the opponent housing 5 located outside the locking lever 4*b* of the housing 4 enters while pushing down the locking lever 4*b* at the time of fitting, and when the hook 4*c* of the locking lever 4*b* is fit into the locking groove 5*b* of the locked portion 5*c*, the housing 5 stops entering, the locking lever 4*b* of the housing 4 is restored to an original position, and the housing 5 is locked with the locked portion 5*c*. As a result, the housings 4 and 5 are not unexpectedly separated from each other, and the electric connectors are connected to each other.

For example, when the housing 4 and the housing 5 are disengaged to separate the connection terminals T and T' from each other, the free end of the locking lever 4*b* may be pushed downward, the hook 4*c* may be removed from the locking groove 5*b*, and the opponent housing 5 may be relatively pulled out from the housing 4.

Note that the terms front and rear, top and bottom, and right and left in the present embodiment are used for description of the drawings, and the actual members are not restricted by these terms.

REFERENCE SIGNS LIST

1, 1' Storage case
2 Storage portion
2*a* Bottom plate
2*c* Partition plate
2*d* Storage groove
2*e* Latching projection
2*i* Temporarily storing portion
3*a*, 3*b* Cover
4, 5 Housing
T, T' Connection terminal
Ta Connection portion
Te Root portion
Tf Insertion end

The invention claimed is:

1. An electric connector that incorporates a storage case accommodating a plurality of connection terminals including temporarily stored portions in a housing, wherein the storage case has a storage portion in which a plurality of storage grooves is arranged in parallel and the connection terminals are stored in the storage grooves, respectively, and a plate-shaped cover is provided at rear edges of outer sides of the temporarily storing portions via a hinge so as to be openable and closable with respect to the storage grooves and covers the storage portion, and tubular temporarily storing portions for temporarily storing the temporarily stored portions of the connection terminals are provided at tip portions of the respective storage grooves.

2. The electric connector according to claim 1, wherein the tubular temporarily storing portions are formed by providing a cover portion that covers the tip portions of the storage grooves at the tip portions of the storage grooves.

3. The electric connector according to claim 1 or 2, wherein each of the connection terminals includes a receiving connection portion of a female connection terminal, and each of the temporarily stored portions is a tip of the receiving connection portion.

4. The electric connector according to claim 1 or 2, wherein each of the connection terminals includes a root portion of an insertion end of a male connection terminal, and each of the temporarily stored portions is the root portion.

5. The electric connector according to any one of claim 1 or 2, wherein the storage grooves are provided on both sides of the storage case.

6. The electric connector according to any one of claim 1 or 2, wherein the storage case is provided with a plurality of latching means for latching the connection terminals at predetermined positions.

* * * * *